US007618133B2

(12) United States Patent
Kubo et al.

(10) Patent No.: US 7,618,133 B2
(45) Date of Patent: Nov. 17, 2009

(54) INK TANK AND RECORDING APPARATUS

(75) Inventors: Koichi Kubo, Yokohama (JP); Shogo Kawamura, Numazu (JP); Tetsuya Ohashi, Matsudo (JP); Ryoji Inoue, Kawasaki (JP); Hideki Ogura, Yokohama (JP); Yasuo Kotaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 491 days.

(21) Appl. No.: 11/467,393

(22) Filed: Aug. 25, 2006

(65) Prior Publication Data

US 2007/0052769 A1 Mar. 8, 2007

(30) Foreign Application Priority Data

Sep. 2, 2005 (JP) ..... 2005-255427

(51) Int. Cl.
*B41J 2/175* (2006.01)

(52) U.S. Cl. ..... 347/85

(58) Field of Classification Search ..... 347/85, 347/86

See application file for complete search history.

(56) References Cited

FOREIGN PATENT DOCUMENTS

| | | | |
|---|---|---|---|
| EP | 0924081 | | 6/1999 |
| JP | H11-240171 | | 9/1999 |
| JP | 2003-266730 | * | 9/2003 |
| JP | 2004-216761 | | 8/2004 |

* cited by examiner

*Primary Examiner*—Julian D Huffman
(74) *Attorney, Agent, or Firm*—Canon USA Inc IP Div

(57) ABSTRACT

An ink tank includes a stirrer supported in a freely moveable manner near an inner wall of an ink storage chamber. When the stirrer moves closest to the inner wall, a predetermined gap is formed between opposing surfaces of the inner wall and the stirrer.

13 Claims, 10 Drawing Sheets

INK TANK AND RECORDING APPARATUS

BACKGROUND OF THE INVENTION

1. Field of the Invention

The present invention relates to an ink tank configured to store recording liquid, such as ink, and a recording apparatus including the ink tank. The present invention can be applied to various recording apparatuses having ink tanks. For example, the present invention can be applied to a typical printer, a copy machine, a facsimile having a communication system, a word processor having a printing unit, and an industrial recording apparatus integrated with various other processing apparatuses.

2. Description of the Related Art

As a recording apparatus that uses ink stored in an ink tank, for example, an inkjet recording apparatus using an inkjet recording head for discharging ink is known. As such an inkjet recording apparatus, a serial scanning type inkjet recording apparatus that includes a carriage holding an inkjet recording head and an ink tank and moves in the primary scanning direction is known.

Such a serial scanning type inkjet recording apparatus includes a carriage that supports an inkjet recording head and an ink tank for supplying ink to the recording head. When recording is carried out, the carriage is moved relative to a recording medium, and ink droplets are discharged from minute outlets provided on the recording head. The ink droplets land on a recording medium to form a predetermined image.

For the inkjet recording head, dye ink including dye as a colorant has been typically used. However, the performance of dye ink is not sufficient when used for recording images on a recording medium to be displayed outdoors because, when displaying an image outdoors, it is important for the ink to have good light resistance and good whether resistance. To replace dye ink in such a case, pigment ink including pigment as a colorant has been provided. However, when pigment ink is used, the pigment particles are deposited at the bottom of the ink tank because pigment ink forms a dispersal system, not a soluble system.

For example, if the inkjet tank is mounted on the inkjet recording apparatus and left untouched for a long period of time, the pigment particles in the ink are gradually deposited in the ink tank. Therefore, a concentration gradient of the pigment particles is generated in a direction from the bottom to the upper area of the ink tank. As a result, the concentration of the pigment particles in the ink at the lower area of the ink tank is increased. Consequently, a layer of highly concentrated pigment particles is formed at the bottom portion of the ink, whereas a layer of less concentrated pigment particles is formed at the upper portion of the ink.

If the ink inside the ink tank is guided outside through the bottom of the ink tank and supplied to a recording head, first, the ink in the highly concentrated pigment layer is supplied, causing an excessively dark image to be formed. In other words, the image formed during early stages of the life of the ink tank and the image formed during a later stage of life of the ink tank may have differences in darkness noticeable by the human eyes. Such differences are especially noticeable when a color image is formed with dark and light colors.

Japanese Patent Laid-Open No. 2004-216761 describes a structure for stirring ink inside an ink tank by moving a stirrer by inertial force generated by the reciprocal movement of a carriage.

More specifically, Japanese Patent Laid-Open No. 2004-216761 describes an ink tank that accommodates a freely shakable stirrer. The center of shaking of the stirrer is set substantially in the center of the ink tank in the direction of the carriage's movement. The stirrer shakes by the same amount in opposite directions when the carriage is reciprocated. Japanese Patent Laid-Open No. 2004-216761 also describes a structure in which a freely movable spherical weight is provided at the bottom of the ink tank and a structure in which a fixed stirring wall that disturbs the ink flow in the ink tank.

However, the ink tanks described in Japanese Patent Laid-Open No. 2004-216761 have the following problems.

When a freely shakable stirrer is provided inside the ink tank, the stirrer shakes by the same amount in opposite directions, and the shaking of the stirrer is centered on substantially the center of the ink tank. Thus, in order to increase the stirring performance by increasing the range of shaking of stirrer, the width of the ink tank has to be increased in the direction of the carriage's movement. However, since a plurality of ink tanks is often mounted on the carriage along the direction of the carriage's movement, the width of each ink tank is limited to a relatively small width. For this reason, the shaking range of the stirrer cannot be increased, and, thus, the ink flow generated by the shaking of the stirrer cannot be increased. To sufficiently stir the ink, the number of times the carriage is reciprocated and the amount of stirring time have to be increased.

The ink tank having a freely movable spherical weight and the ink tank having a fixed stirring wall have simple structures. However, for the former ink tank, it is difficult to sufficiently stir the entire volume of ink, including the ink close to the upper surface of the ink tank, by merely moving the weight provided at the bottom of the ink tank. For the latter ink tank, a fixed stirring wall is provided to disturb the ink flow on the presumption that an ink flow is generated. In other words, the fixed stirring wall does not actively generate an ink flow. Furthermore, both of the ink tanks do not effectively operate unless structures allowing air to be taken in to the ink storage unit in accordance with the decrease in the volume of ink are provided. In other words, a space is created inside the ink storage unit as air is taken in, and this space is used to move the ink while the carriage is being reciprocated.

However, some ink tanks have structures that do not allow air to be taken in. The only amount of air the ink storage unit of such an ink tank accommodates is some bobbles of air that enter during production and shipment. Therefore, there is not enough space (air) for the ink to move inside the ink tank. Accordingly, it is difficult to generate a strong flow of ink by reciprocating the carriage and/or moving a spherical weight.

These problems in the ink tank described in Japanese Patent Laid-Open No. 2004-216761 are also apparent from the structure of a typical ink tank and recording apparatus described below.

In general, an ink tank held by a carriage (which is known as an "on-carriage ink tank") has a predetermined width and a predetermined length to improve the detachment and attachment of the ink tank. More specifically, the width of the ink tank in the direction of the carriage's movement (i.e., primary scanning direction) is relatively small, whereas the length of the ink tank in the conveying direction of the recording medium (i.e., secondary scanning direction orthogonal to the primary scanning direction) is relatively great. Consequently, the stirrer cannot be moved a great distance in the primary scanning direction, which is the displacement direction of the stirrer. As a result, the stirrer is moved only a small distance, preventing a strong flow of ink from being generated in the ink tank. Accordingly, the ink-stirring efficiency is reduced, and a great amount of time will be required to stir the entire volume of ink in the ink tank. For example, if pigment particles in the ink are deposited at the bottom of the ink tank because recording had not been carried out by the recording apparatus for a long period of time while the ink tank was attached to the carriage, the carriage will have to be reciprocated for a long period of time before carrying out recording again. As a result, the warm-up time required for enabling a recording operation will become long. In particular, when the pigment particles in the pigment ink are great and/or when the relative density of the pigment particles is great, the pigment particles are deposited quickly. Therefore, a concentration distribution causing negative effects on the image formed by the recording apparatus may be generated inside the ink tank by merely leaving the ink tank untouched for several days. To prevent this, the ink in the ink tank must be stirred every several days. However, while the ink is being stirred, image formation cannot be carried out.

SUMMARY OF THE INVENTION

The present invention is directed to an ink tank configured to efficiently stir ink stored inside the ink tank and a recording apparatus configured to form high quality images by using ink having a uniform concentration.

According to an aspect of the present invention, an ink tank includes an ink storage chamber configured to store ink, the ink storage chamber having an ink supply port facilitating supplying the ink stored in the ink storage chamber to the outside of the ink tank, a stirrer supported in a freely moveable manner inside the ink storage chamber, a supporting member that is provided near a first inner wall of the ink storage chamber and that supports the stirrer in the freely moveable manner in directions toward and away the first inner wall, and a limiting unit configured to limit a position of the stirrer by forming a predetermined gap between opposing surfaces of the stirrer and the first inner wall when the stirrer moves closest to the first inner wall.

According to another aspect of the present invention, a recording apparatus configured to record an image on a recording medium using ink supplied from the ink supply port of the ink tank as provided above mounted on the mounting unit, the apparatus including a mounting unit configured to hold the ink tank and a moving unit configured to reciprocate the ink tank mounted on the mounting unit so as to move the stirrer by inertial force.

The stirrer is a member that has a relative density greater than ink and has weight and rigidity great enough to move through ink by inertial force caused by the movement of the ink tank.

According to embodiments of the present invention, a stirrer is supported in a freely moveable manner near an inner wall of an ink storage chamber. When the stirrer moves closest to the inner wall, a predetermined gap is formed between opposing surfaces of the inner wall and the stirrer. In this way, ink is interposed between the opposing surfaces of the inner wall and the stirrer, causing a strong ink flow to be generated. When the stirrer is moved in a direction away from the inner wall, ink flows into the gap formed between the opposing surfaces. In this way, the stirrer is moved reliable.

As a result, the ink inside the ink storage chamber is efficiently stirred, and the concentration of the ink inside the ink tank is uniformized to enable recording of a high quality image.

Further features of the present invention will become apparent from the following description of exemplary embodiments (with reference to the attached drawings).

DESCRIPTION OF THE EMBODIMENTS

Embodiments of the present invention will be described below with reference to the drawings.

First Embodiment (Structure of Recording Apparatus)

Figure 13:
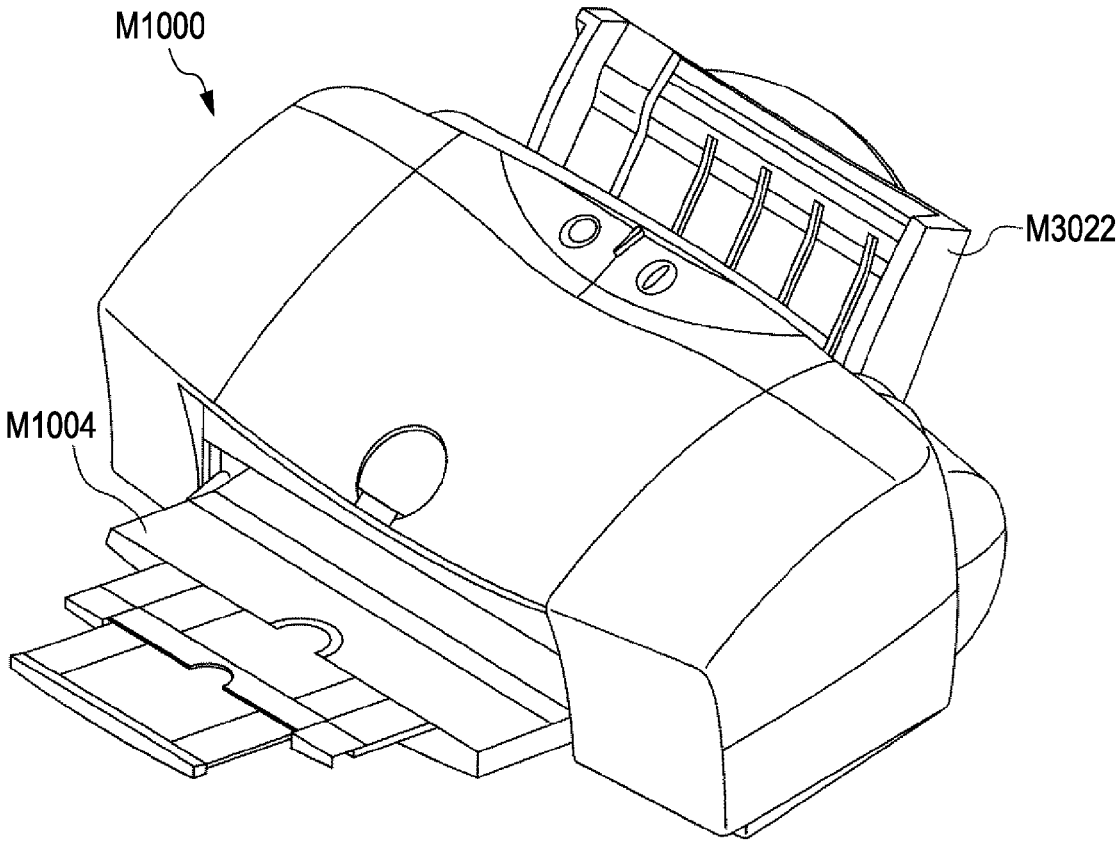
FIG. 13 is a perspective view of an inkjet recording apparatus employing an embodiment of the present invention.
Figure 14:
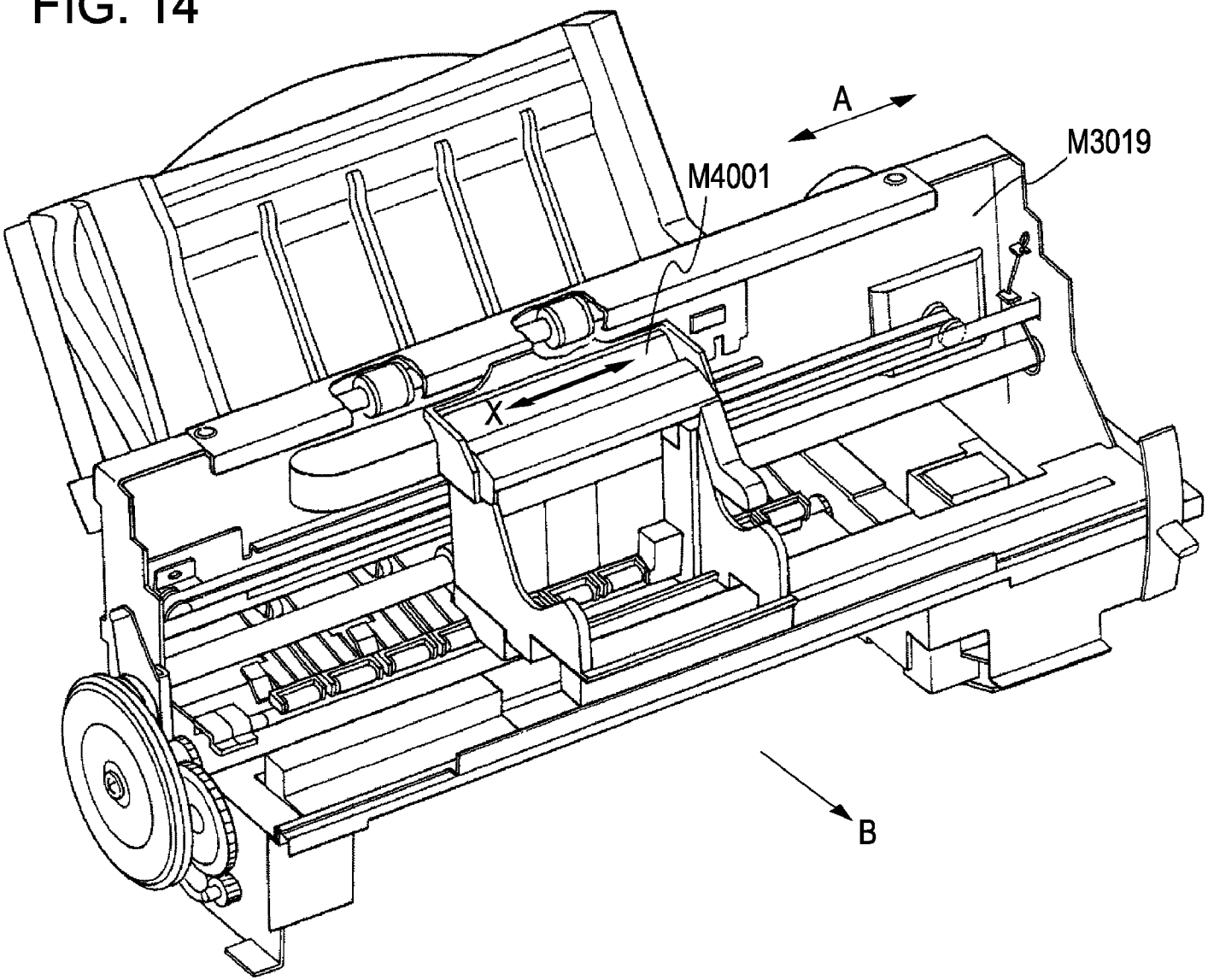
FIG. 14 is a perspective view of the structure of the inside of the inkjet recording apparatus illustrated in FIG. 13.

FIGS. 13 and 14 illustrate example structures of an inkjet recording apparatus according to an embodiment of the present invention.

As shown in FIG. 13, an inkjet recording apparatus according to this embodiment includes a main body M1000, a supplying unit M3022, and an eject tray M1004. As shown in FIG. 14, the main body M1000 includes a chassis M3019 and a recording mechanism. The recording mechanism includes a carriage M4001 capable of reciprocating in a primary scanning direction indicated by the arrow A. The carriage M4001 holds an ink tank for storing ink and an inkjet recording head capable of discharging the ink stored in the ink tank from a plurality of ink outlets. The ink tank and the recording head may constitute a single unit, i.e., ink cartridge, or, instead, the ink tank may be detachable from the recording head. The recording head, for example, discharges ink using electrothermal conversion bodies (i.e., heaters) or piezoelectric elements. When electrothermal conversion bodies are used, heat generated by the bodies cause the ink to boil. This boiling energy is used to discharge ink from ink outlets. A recording sheet (recording medium) supplying unit M3022 is conveyed in the secondary scanning direction that is orthogonal to the primary scanning direction and is indicated by the arrow B.

When recording an image on the recording sheet, a recording operation and a conveying operation are alternately repeated. During the recording operation, ink is discharged from the ink outlets while the recoding head moves in the primary scanning direction together with the carriage M4001 and the ink tank. During the conveying operation, the recording sheet is conveyed in the secondary scanning direction by a predetermined length. By repeating such recording and conveying operations, an image is formed on the recording sheet.

Such an inkjet recording apparatus employs a so-called non-impact recording method and is capable of high speed recording and carrying out recording on various types of recording media. Furthermore, since almost no noise is generated during recording, such an inkjet recording apparatus is often used as a recording mechanism of an apparatus such as a printer, a word processor, a facsimile, and a copy machine.

(Structure of Ink Tank)

Figure 1:
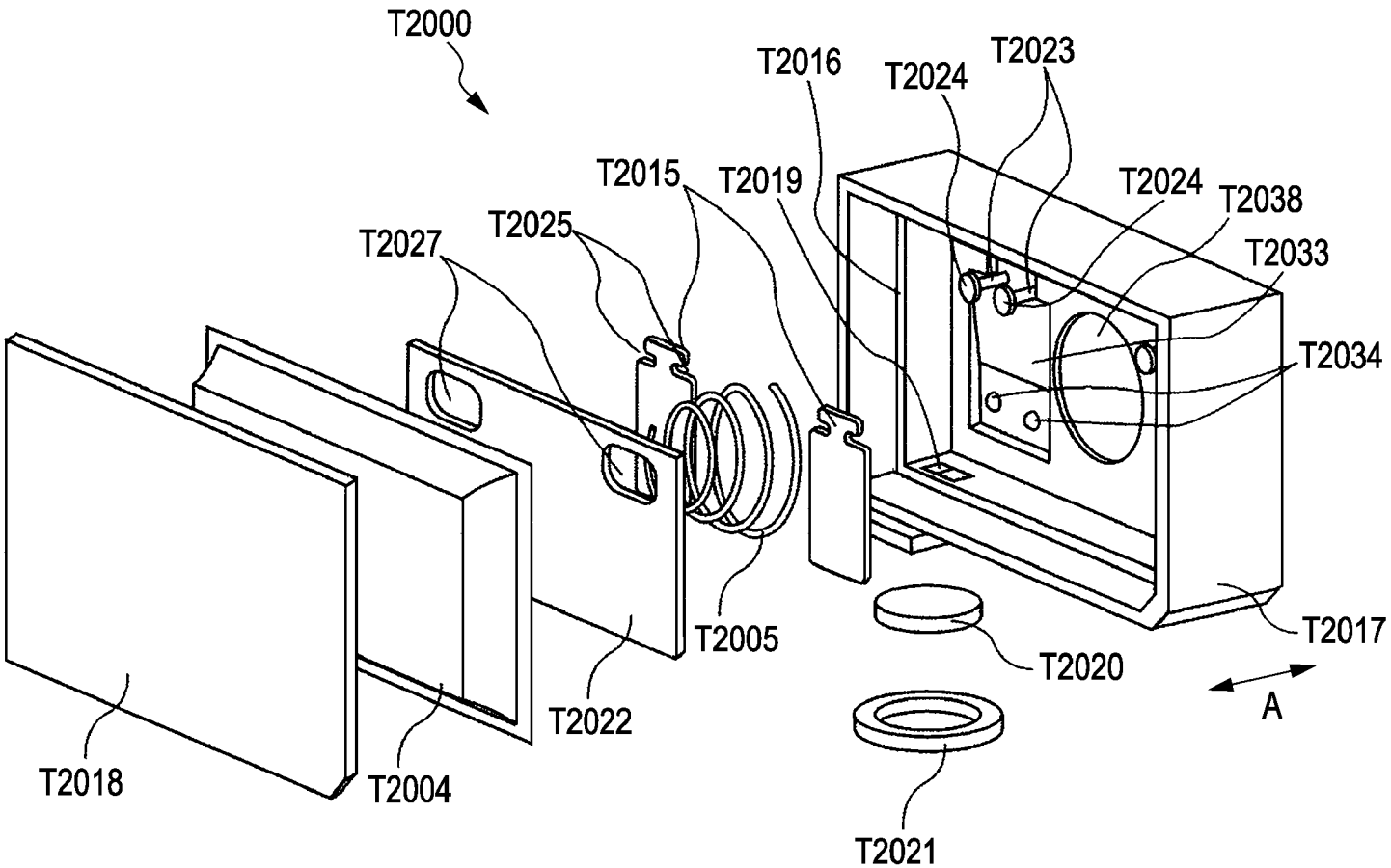
FIG. 1 is an exploded perspective view illustrating an ink tank according to a first embodiment.
Figure 2:
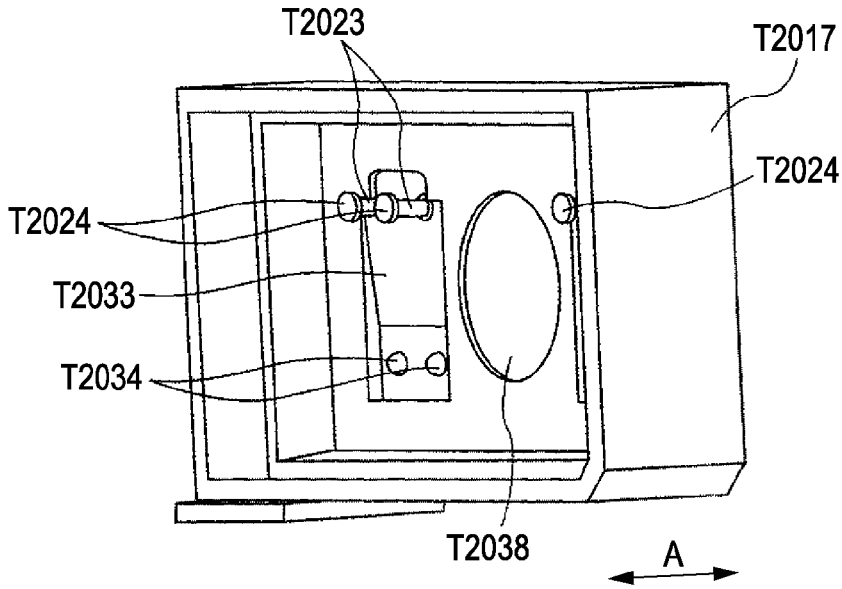
FIG. 2 is an enlarged perspective view illustrating a container body of the ink tank illustrated in FIG. 1.
Figure 3:
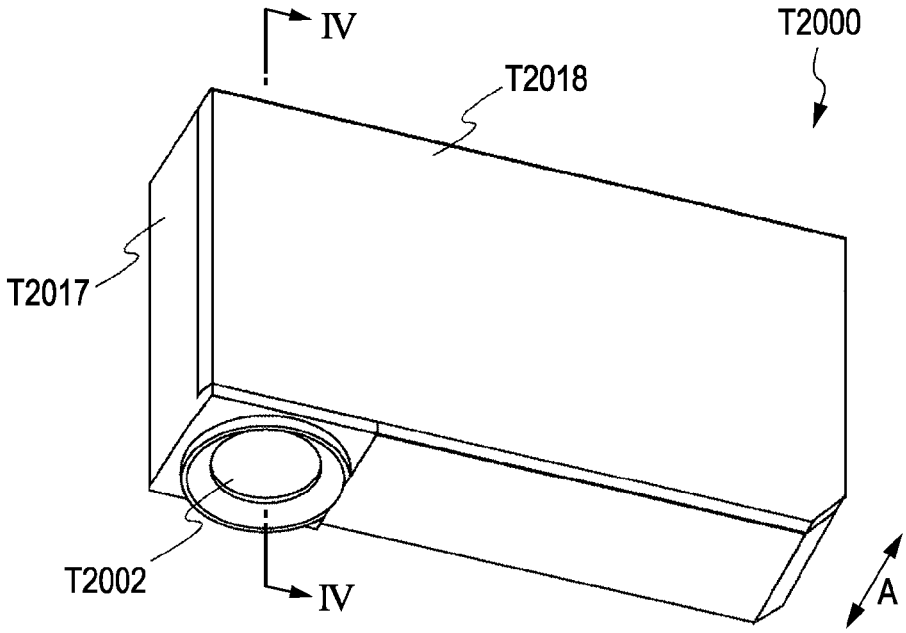
FIG. 3 is a perspective view illustrating the external structure of the ink tank.

FIG. 1 is an exploded perspective view illustrating an ink tank according to a first embodiment. FIG. 2 is a perspective view illustrating the inner structure of the ink tank. FIG. 3 is a perspective view illustrating the external structure of the ink tank. FIGS. 4A to 4D are cross-sectional views taken along line IV-IV in FIG. 3 and illustrate the stirring movement of the ink tank.

An ink tank T2000 is a container for storing ink. As shown in FIG. 2, the chassis of the ink tank T2000 is constituted of a container body T2017 and a covering member T2018. An ink storage chamber T2001, described below, is formed inside the ink tank T2000. At the bottom of the ink tank T2000, an ink supply port T2002 for supplying ink is provided on the recording head (not shown in the drawings).

The ink tank T2000 includes the container body T2017, a spring member T2005, a plate T2022, a flexible film T2004, the covering member T2018, a meniscus generating member T2020, a holding plate T2021, and stirrers T2015. The container body T2017 and the covering member T2018 are, for example, composed of polypropylene. As shown in FIGS. 1 and 4, the meniscus generating member T2020 is disposed at the bottom of the container body T2017 when in an operational state (i.e., a state of being mounted on a desktop printer). On the outer periphery of the meniscus generating member T2020, the holding plate T2021 is provided. The meniscus generating member T2020, for example, is a capillary member generating a capillary effect and being made of a polypropylene fiber material or, instead, is an integrated unit of the capillary member and a filter. The filter, for example, has a permeability dimension of about 15 to 30 μm and is composed of a stainless material or polypropylene. The meniscus generating member T2020 and the inside of the container body T2017 communicate with each other through an ink channel T2019. A meniscus of ink is formed to prevent air bubbles from entering the ink storage chamber T2001, described below, from outside.

The ink storage chamber T2001 for storing ink i5000 is formed in the container body T2017 by depositing the flexible film T2004 on a peripheral portion T2016 of an opening. The flexible film T2004, for example, is a film (having a thickness of about 20 to 100 μm) including a polypropylene thin film. The spring member T2005 urges the plate T2022 to further urge the flexible film T2004 outwards. As a result of the urging, a negative pressure is generated inside the ink storage chamber T2001. A depression T2038 for adjusting the position of the spring member T2005 is provided on the inner surface of the container body T2017. The spring member T2005 and the plate T2022, for example, are composed of a stainless material. The covering member T2018 is attached over the opening of the container body T2017 so as to protect the flexible film T2004 that protrudes outwards. An atmosphere communication unit (not shown) is provided on the covering member T2018 to adjust the pressure of the ink storage chamber T2001 to atmospheric pressure.

When the ink i5000 inside the ink storage chamber T2001 is supplied to the recording head for consumption, the flexible film T2004 bends as the spring member T2005 is compressed. As a result, the volume of the ink storage chamber T2001 decreases. An opening T2027 is provided on the plate T2022 so as to prevent interference with supports T2023, described below. A depression T2033 that is large enough to store all of the stirrers T2015 is provided on the container body T2017 so as to prevent the plate T2022 from interfering with the stirrers T2015. In this way, the ink i5000 stored inside the ink storage chamber T2001 can be consumed until the volume of the ink storage chamber T2001 is reduced to the extent in which the plate T2022 comes into contact with the inner wall of the container body T2017. The depression T2033 may only store parts of the stirrers T2015.

(Structure of Stirring Mechanism)

Stirring mechanisms configured to stir ink are provided inside the ink storage chamber T2001. According to this embodiment, two stirring mechanisms that interpose the spring member T2005 are provided. Each of the stirring mechanisms includes two supporting members T2023 provided on the inner wall of the container body T2017 and one stirrer T2015. The supporting members T2023 support one end of the stirrer T2015. Each of the supporting members T2023 includes a shaft extending in the direction of the movement of the carriage M4001 mounted on the main body M1000 (i.e., direction indicated by the arrow A) and a stopper T2024 provided at the tip of the shaft. The supporting member T2023, for example, is a boss that is composed of a resin and provided on the container body T2017. The stopper T2024 that is shaped as a rivet and that is expanded by heat processing is provided at the tip of the supporting members T2023. Here, a stirrer is a member that has a relative density greater than ink and has weight and rigidity great enough to move through ink by inertial force caused by the movement of the ink tank.

The stirrer T2015 according to this embodiment is constituted of a plate. On one of the ends, notches T2025 that engage with the supporting members T2023 are provided. The supporting members T2023 according to this embodiment are composed of a stainless material. However, the material of the supporting members T2023 is not limited and may be any other material, such as resin, so long as the relative density of the material is greater than ink.

The shafts of the supporting members T2023 fit into the notches T2025 of the stirrer T2015 with some clearance. The stoppers T2024 are formed to provide clearance for the stirrer T2015 to move in the thickness direction. The two supporting members T2023 are fit into the two notches T2025 provided on the stirrer T2015 to interpose and support the stirrer T2015 in a freely moveable manner. According to this embodiment, two supporting members T2023 are disposed in the horizontal direction, parallel to each other. In this way, as described below, a pivotal axis is formed when the stirrers T2015 is pivoted in the thickness direction of the ink tank (i.e., when moved at a rotational angle within a range not exceeding the thickness of the ink tank), and the ink is effectively stirred.

Suppose, for instance, only one supporting member T2023 is provided. The stirrer T2015 will be supported at only one point. In such a case, a rotary axis is not generated when the stirrer T2015 pivots in the thickness direction of the ink tank, and the stirrer T2015 will move freely. Consequently, the stirrer T2015 will move inside the ink storage chamber T2001 at an angle that receives less resistance from the ink. As a result, the ink will not be sufficiently stirred.

One end of the stirrer T2015 is attached to the container body T2017 by two of the supporting members T2023. Accordingly, the stirrer T2015 can freely move linearly along the longitudinal direction of the supporting members T2023 and freely pivot around supporting points on the supporting members T2023 within a range not exceeding the thickness of the ink tank.

Figure 7:
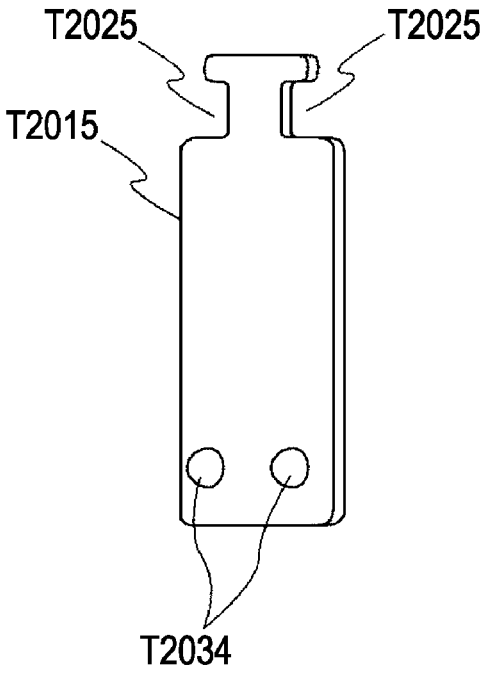
FIG. 7 is a perspective view illustrating a variation of the stirrer of the ink tank illustrated in FIG. 1.

Protrusions T2034 are provided in the depression T2033 that is formed on the container body T2017. The protrusions T2034 are provided to reduce the contact area of the stirrer T2015 and the container body T2017 and to form a gap between the stirrer T2015 and the container body T2017. According to this embodiment, two semi-spherical protrusions are provided as the two protrusions T2034 in the depression T2033. However, so long as the protrusions T2034 achieve the above-described effects, the shape and number of the protrusions T2034 are not limited. As shown in FIG. 7, to achieve the same effects as described above, the protrusions T2034 may be provided on the surface of the stirrer T2015 that comes into contact with the container body T2017.

The stirrer T2015 disposed inside the depression T2033 is lift up away from the depression T2033 by the protrusions T2034 provided in the depression T2033, or on the stirrer T2015, as illustrated in FIG. 7. Therefore, to enable the stirrer T2015 to be stored inside the depression T2033, the depth of the depression T2033 is set to a value greater than the sum of the thickness of the stirrer T2015 and the height of the protrusions T2034.

Figure 4A:
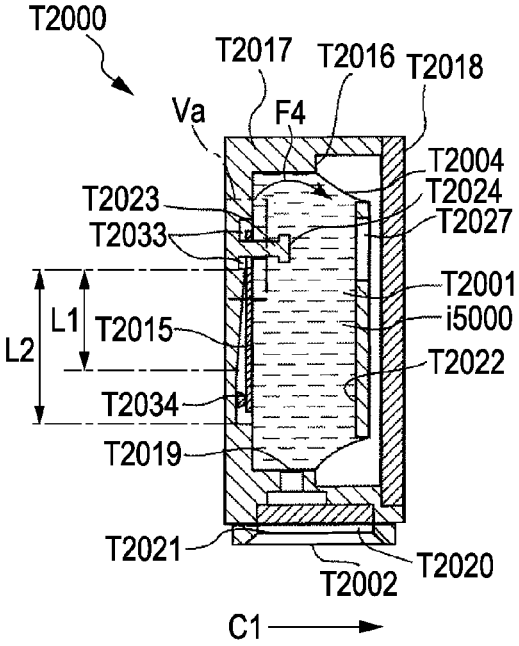
FIGS. 4A, 4B, 4C, and 4D are cross-sectional views taken along line IV-IV in FIG. 3 and illustrate the stirring movement of the ink tank illustrated in FIG. 1.

At part of the depression T2033 according to this embodiment, a tilted surface is formed within the range L1 indicated in FIG. 4A. One reason for providing such a tilted surface is to increase the thickness of the container body T2017 at the area where the thickness of the container body T2017 is reduced because of the depression T2033 so as to increase the strength of the container body T2017. Another reason for providing such a tilted surface is to minimize the gap between the container body T2017 and the stirrer T2015 so as to reduce the amount of unusable ink trapped in the gap. This tilted surface may be provided within the range L2 that reaches the lower edge of the depression T2033.

(Operation of Stirring Mechanism)

FIGS. 4A to 4D are cross-sectional views taken along line IV-IV in FIG. 3 and illustrate the operation of the stirrer T2015. FIG. 5A is an enlarged view of an area Va in FIG. 4A. FIG. 5B is an enlarged view of an area Vb in FIG. 4B.

FIG. 4A illustrates a first state of the stirrer T2015. When the ink tank T2000 moves in the direction indicated by the arrow C1 together with the carriage M4001 that is moved in a first direction, inertial force causes each of the stirrers T2015 inside the ink storage chamber T2001 to be pressed against part of the inner surface of the depression T2033 and the protrusions T2034.

Figure 4B:
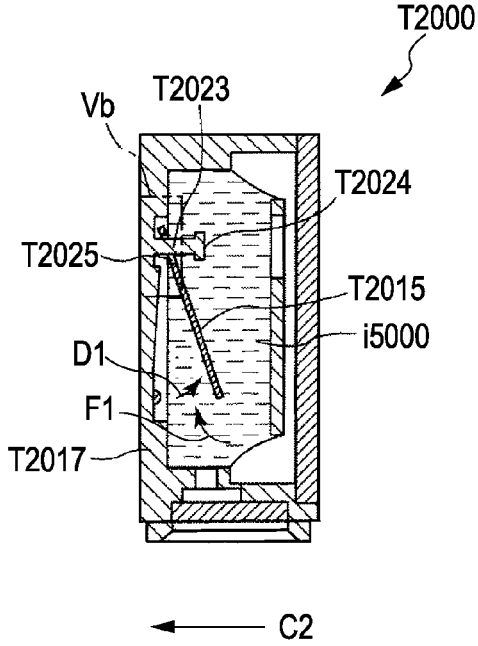
Figure 5A:
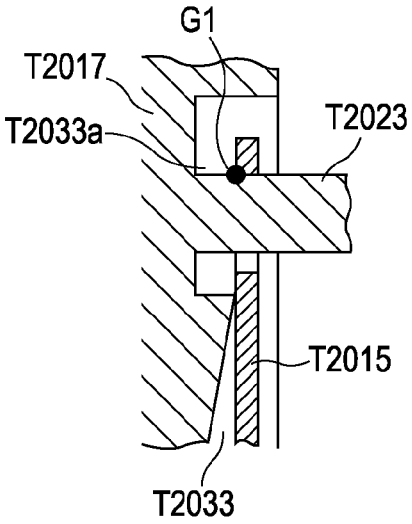
FIG. 5A is an enlarged view of an area Va in FIG. 4A.
Figure 5B:
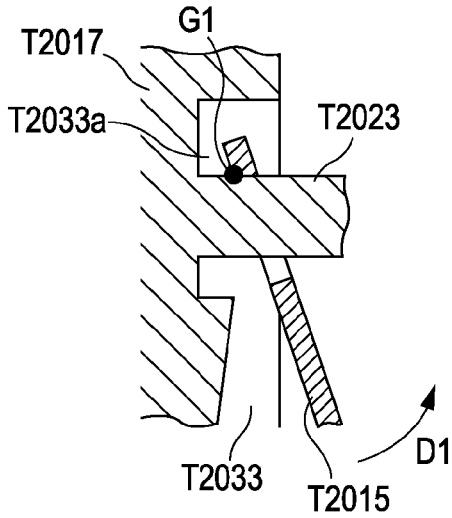
FIG. 5B is an enlarged view of an area Vb in FIG. 4B.

FIG. 4B illustrates a second state of the stirrer T2015. Since the carriage M4001 is reciprocated, the carriage M4001 starts moving in a second direction when it reaches a predetermined point. When the carriage M4001 starts moving in the second direction, the ink tank T2000 starts moving in the direction indicated by the arrow C2. At this time, inertial force causes the free end (i.e., lower end) of the stirrer T2015 to start pivoting (i.e., moving) around the supporting members T2023 in the direction indicated by the arrow D1. The pivoting is tolerated by the gap between the notches T2025 of the stirrer T2015 and the shafts of the supporting members T2023. The pivot fulcrum is set at a contact area G1 of the stirrer T2015 and the supporting members T2023, as shown in FIGS. 5A and 5B.

Figure 6A:
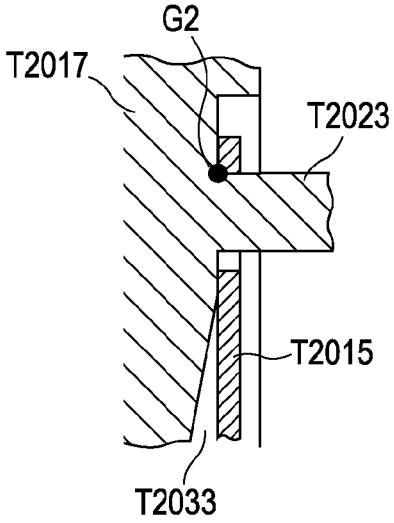
FIGS. 6A and 6B illustrate comparative examples corresponding to FIGS. 5A and 5B.
Figure 6B:
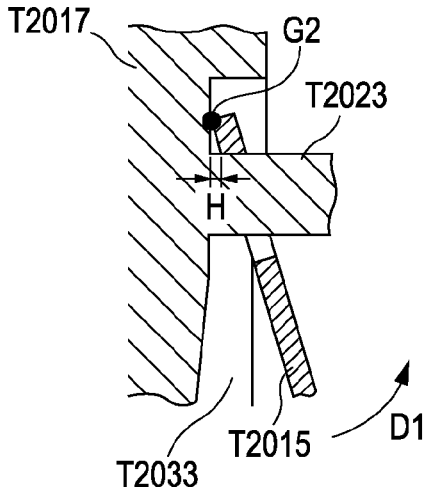

As illustrated in FIGS. 6A and 6B, if a part of the stirrer T2015 above the supporting members T2023 comes into contact with the inner wall of the container body T2017, the pivoting and sliding of the stirrer T2015 may be inhibited. The pivoting and sliding may be inhibited because the pivot fulcrum of the stirrer T2015 moves to a contact area G2 of the stirrer T2015 and the container body T2017. More specifically, for the stirrer T2015 to pivot in the direction indicated by the arrow D1, the stirrer T2015 has to be rubbed against the upper surface of the supporting member T2023 for a distance H, causing frictional force to be generated between the stirrer T2015 and the supporting member T2023. This frictional force interferes with the pivoting and sliding (i.e., movement along the shafts of the supporting members T2023) of the stirrer T2015.

In contrast, according to this embodiment, an area T2033*a* of the depression T2033 is deeper than the other areas of the depression T2033, as shown in FIGS. 5A and 5B. Therefore, in the state illustrated in FIG. 5A, the part of the stirrer T2015 above the supporting members T2023 does not come into contact with the container body T2017. Because of this structure, the fulcrum of the stirrer T2015 is set at the contact area G1 of the stirrer T2015 and the supporting member T2023. The frictional force generated at the contact area G1 is small enough to not have any affect on the pivoting and sliding of the stirrer T2015. Thus, the stirrer T2015 moves smoothly.

Next, at the same time the stirrer T2015 starts pivoting in the direction indicated by the arrow D1, the ink i5000 flows into the gap formed by the protrusions T2034 between the stirrer T2015 and the container body T2017 in the direction indicated by the arrow F1 in FIG. 4B. At this time, if the gap formed by the protrusions T2034 between the stirrer T2015 and the container body T2017 is too small, a resistive force is applied to the ink i5000 flowing into the gap. This resistive force interferes with the movement of the stirrer T2015 along the shafts of the supporting members T2023. According to this embodiment, by adjusting the height of the protrusions T2034, the gap between the stirrer T2015 and the container body T2017 is set to an optimal value. For example, the stirrer T2015 made of stainless steel has a length of about 20 mm, width of about 10 mm, thickness of about 0.4 mm, and mass of about 0.5 g. Further, the size of the gap formed by the protrusions T2034 is about 0.2 mm, and the size of the depression formed by depressing the inner wall of the container body is about 0.55 mm. Thus, the resistive force is small enough so that the movement of the stirrer T2015 is not affected. As a result, the stirrer T2015 moves smoothly.

Figure 4C:
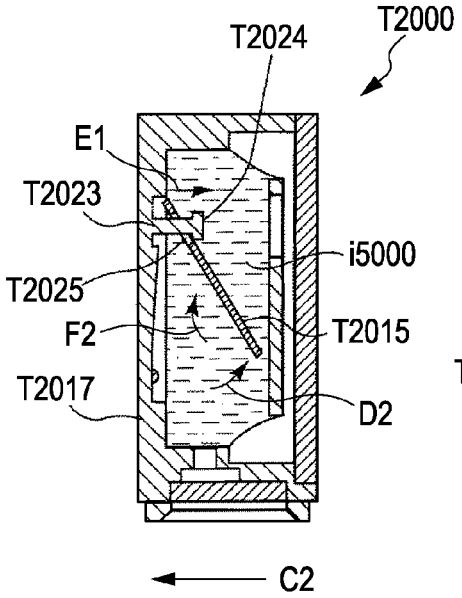

FIG. 4C illustrates a third state of the stirrer T2015. When the ink tank T2000 moves further in the direction indicated by the arrow C2, the base (i.e., the end closer to the supporting members T2023) of the stirrer T2015 also starts moving in the direction indicated by the arrow C2 because of inertial force. In other words, the entire stirrer T2015 moves along the shafts of the supporting members T2023 in the direction indicated by the arrow E1. Accordingly, the base of the stirrer T2015 moves away from the inner wall of the container body T2017. When the base comes into contact with the stoppers T2024, the free end of the stirrer T2015 starts pivoting in the direction indicated by the arrow D2. The ink i5000 flows in the direction indicated by the arrow F2 into the gap formed between the stirrer T2015 and the container body T2017 as a result of the base of the stirrer T2015 moving in the direction indicated by the arrow E1.

Figure 4D:
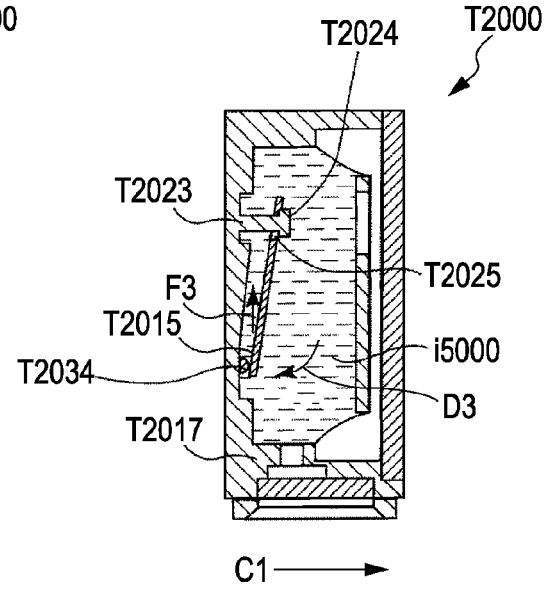

FIG. 4D illustrates a fourth state of the stirrer T2015. When the carriage M4001 starts moving in the opposite direction, the ink tank T2000 starts moving in the direction indicated by the arrow C1 together with the carriage M4001. As a result, first, the free end of the stirrer T2015 starts moving by inertial force. Then, the free end of the stirrer T2015 starts pivoting around the supporting members T2023 in the direction indicated by the arrow D3 until it comes into contact with the inner wall of the container body T2017. Subsequently, the base of the stirrer T2015 moves along the shafts of the supporting members T2023 in the direction indicated by the arrow E2. As the stirrer T2015 moves closer to the inner wall of the container body T2017, the ink i5000 between the stirrer T2015 and the inner wall of the container body T2017 starts to flow in the direction indicated by the arrow F3.

The pivoting and sliding of the stirrer T2015 causes the stirrer T2015 to return from the fourth state to the first state illustrated in FIG. 4A. When the stirrer T2015 and the inner wall of the container body T2017 come into contact or come close to each other, the ink i5000 moves in the direction indicated by the arrow F4.

Accordingly, the stirrer T2015 stirs the ink i5000 by repeating the first to fourth states as the carriage M4001 is reciprocated. In other words, the stirrer T2015 carries out a stirring motion by using inertial force generated by the movement of the carriage M4001 provided on the body of the apparatus.

The frictional resistance generated between the stirrer T2015 and the supporting members T2023 during such a stirring motion enables the following movement of the stirrer T2015. The free end of the stirrer T2015 first starts pivoting when the carriage M4001 moves in one direction. Then, the base of the stirrer T2015 moves along the shafts of the supporting members T2023. Such a movement of the stirrer T2015 generates a pumping effect, causing the ink i5000 in the ink storage chamber T2001 to be circulated. Moreover, the stirrer T2015 according to this embodiment is capable of sufficiently stirring the pigment component of ink being deposited in the lower area of the ink storage chamber T2001 since the free end of the stirrer T2015, which is the end that moves greatly, is located at the lower area in the vertical direction. The entire volume of the ink i5000 in the ink storage chamber T2001 can be sufficiently stirred by the stirring by the free end of the stirrer T2015 and the pumping effect of the stirrer T2015. The movement of the stirrer T2015 also causes the ink i5000 to move and be stirred in the horizontal direction of the stirrer T2015.

By reducing the frictional force that interferes with the movement of the stirrer T2015, the stirrer T2015 can be moved smoothly to carry out efficient stirring. By storing the stirrer T2015 inside the depression T2033 formed by depressing the inner wall of the container body T2017, substantially all of the ink i5000 in the ink storage chamber T2001 can be consumed. More specifically, the plate T2022 can be moved close to the inner wall of the container body T2017 to the position corresponding to the position where all of the ink i5000 in the ink storage chamber T2001 is consumed.

Figure 8:
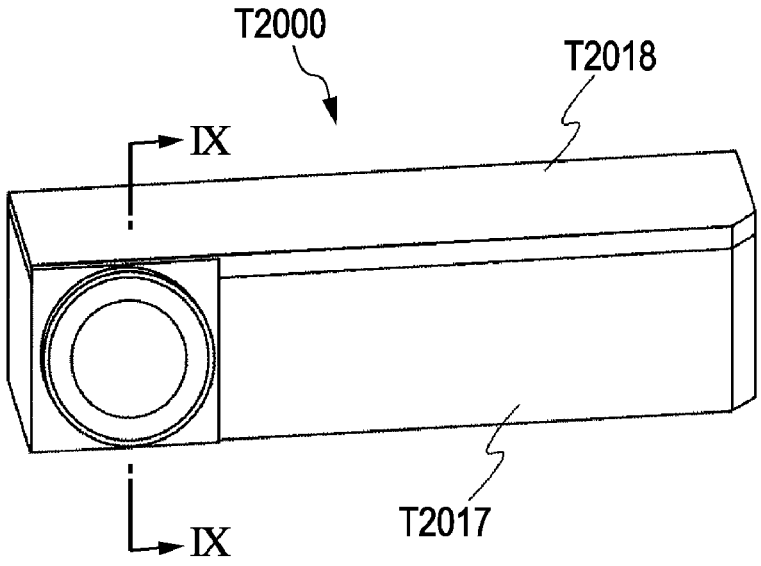
FIG. 8 is a perspective view illustrating an example orientation of the ink tank illustrated FIG. 1 being left untouched.
Figure 9:
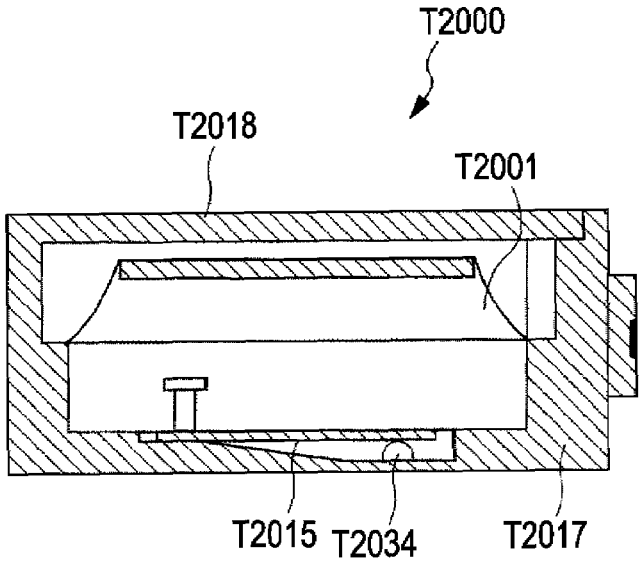
FIG. 9 is a cross-sectional view of an ink tank taken along line IX-IX in FIG. 8.

During shipping of the ink tank T2000 or while a shop or a user stores the ink tank T2000, the ink tank T2000 may be left untouched for a long period of time with the side of the container body T2017 facing downward, as shown in FIG. 8. In such as case, also, a gap is formed between the container body T2017 and the stirrers T2015 by the protrusions T2034. In this way, the stirrers T2015 do not come into close contact with the container body T2017. Therefore, the stirring motion of the stirrers T2015 can be carried out immediately after the ink tank T2000 is installed to the recording apparatus.

Accordingly, the ink tank T2000 according to this embodiment has a simple structure and is capable of efficiently stirring pigment ink stored inside the ink storage chamber T2001. Thus, the concentration of the pigment component of the ink can be uniformized, and the amount of unconsumed ink can be reduced. As a result, an eco-friendly and inexpensive ink tank and an inkjet recording apparatus capable of high quality recording of an image without wasting ink are provided.

Second Embodiment

Figure 10:
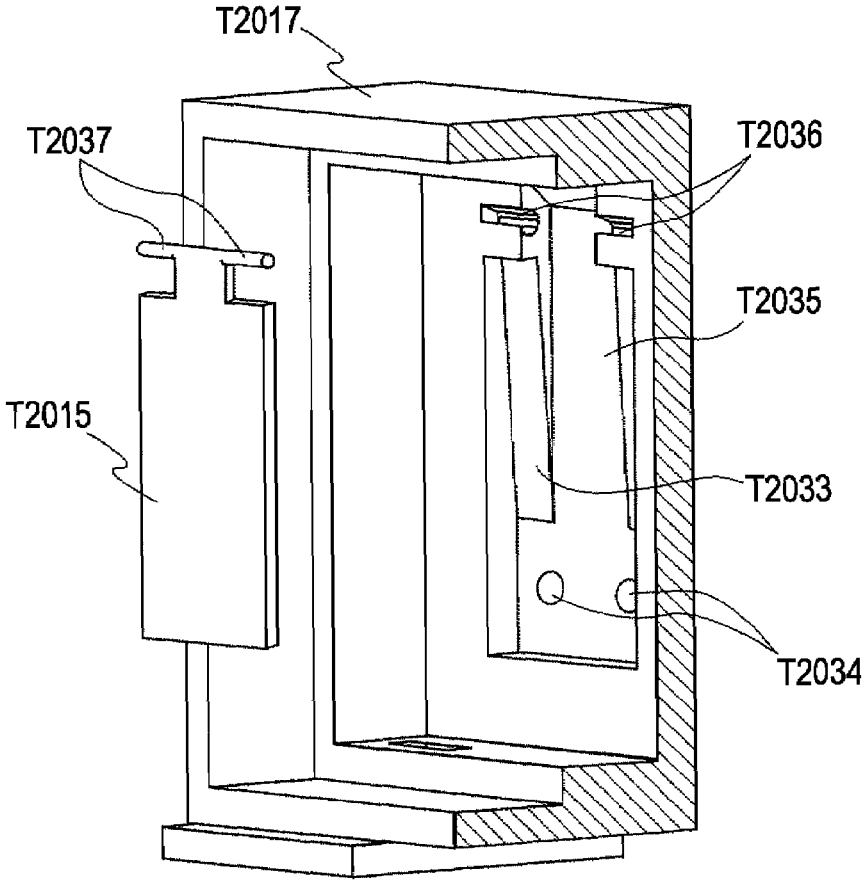
FIG. 10 is an exploded perspective view illustrating an ink tank according to a second embodiment.
Figure 11C:
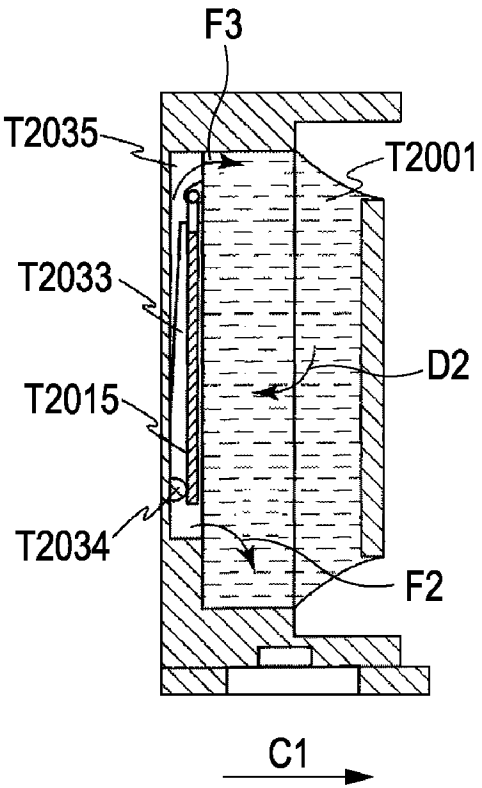
FIGS. 11A, 11B, and 11C are cross-sectional views illustrating the stirring movement of the ink tank illustrated in FIG. 10.
Figure 11B:
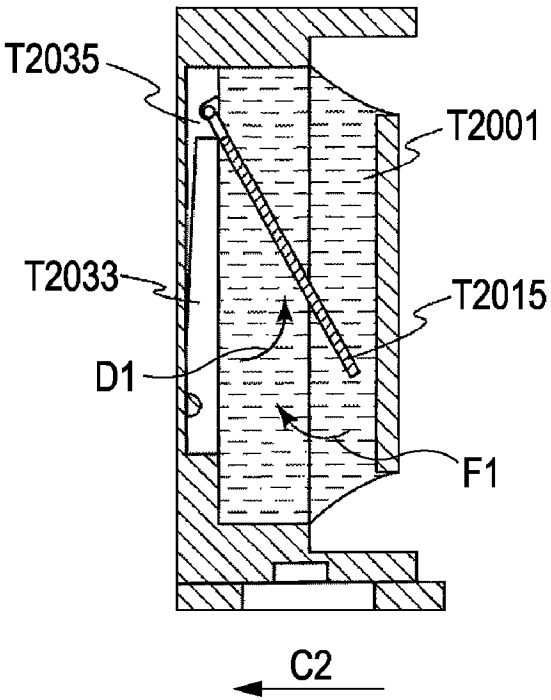
Figure 11A:
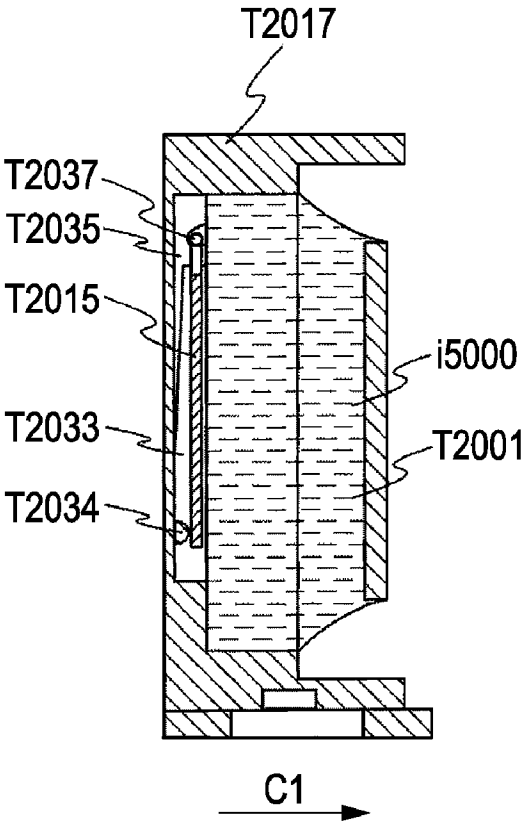
Figure 12:
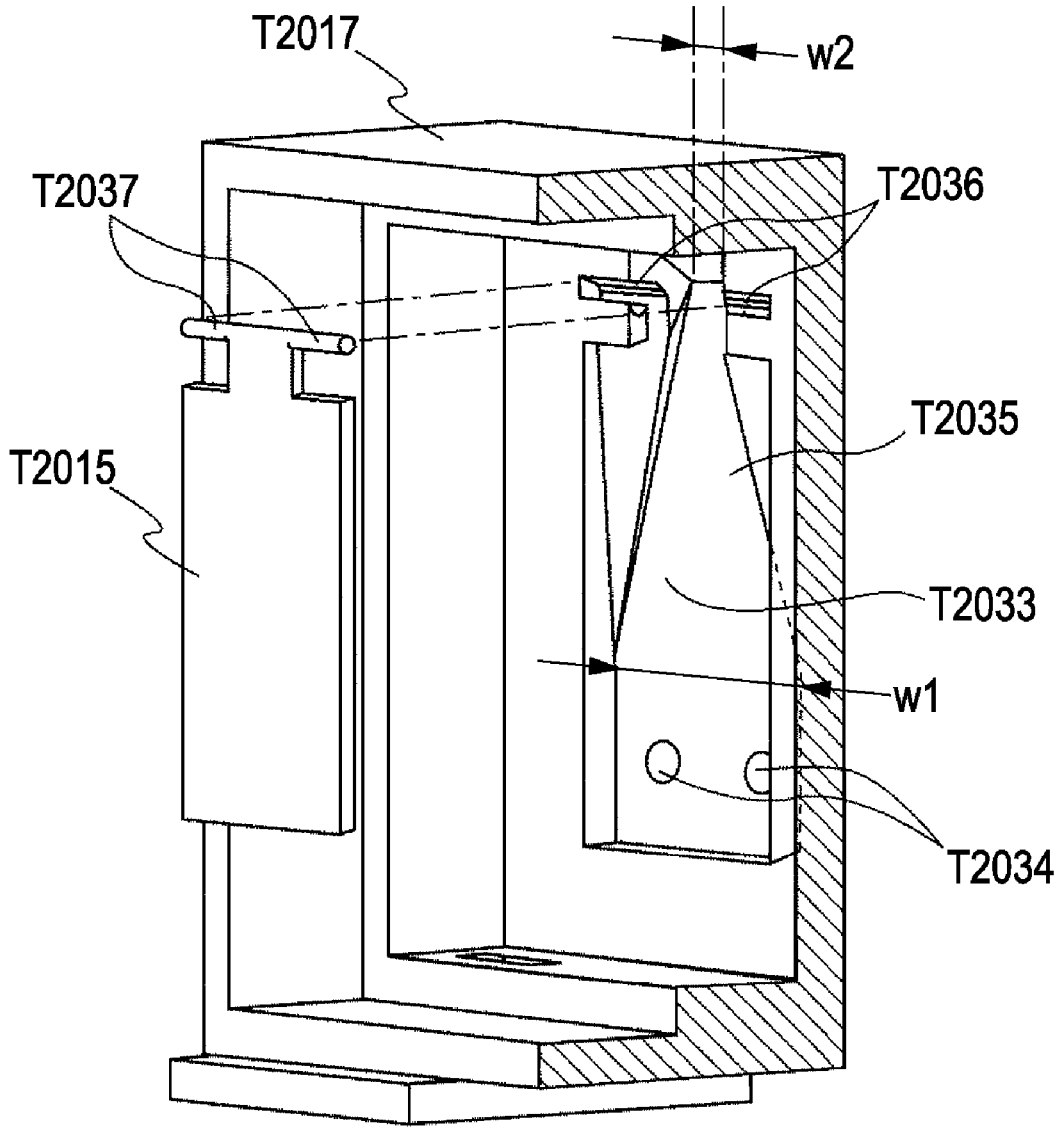
FIG. 12 is an exploded perspective view of the main component of a variation of a channel in the ink tank illustrated in FIG. 10.

FIGS. 10 to 12 illustrate an ink tank according to a second embodiment of the present invention. The structure and movement of the stirring mechanisms of the ink tank T2000 according to the second embodiment differs from those of the ink tank according to the first embodiment to some extent. Other features of the second embodiment that are the same as those of the first embodiment, and descriptions thereof are not repeated.

(Structure of Stirring Mechanism)

Similar to the first embodiment, two ink stirring mechanisms that interpose a spring member T2005 are provided inside an ink storage chamber T2001 of the ink tank T2000. The two stirring mechanisms have identical structures and operate in the identical ways. Therefore, in the following, only one stirring mechanism will be described.

FIG. 10 is an exploded perspective view illustrating the stirring mechanism according to this embodiment.

The stirring mechanism according to this embodiment includes a depression T2033 formed in the inner wall of a container body T2017, protrusions T2034, a channel T2035, supporting holes T2036, and a stirrer T2015 supported by the supporting holes T2036. Since the structures of the depression T2033 and the protrusions T2034 are the same as the structures of those according to first embodiment, descriptions thereof are not repeated.

The stirrer T2015 according to this embodiment is constituted of a plate and has supporting shafts T2037 that engage with the supporting holes T2036 of the container body T2017. The stirrer T2015 according to this embodiment is composed of stainless material. However, the material of the stirrer T2015 is not limited, and the stirrer T2015 may be composed of any material, such as resin, that has a relative density greater than ink.

The supporting holes T2036 have undercut areas for rotatably supporting the supporting shafts T2037. By firmly fitting the supporting shafts T2037 of the stirrer T2015 into the supporting holes T2036, the stirrer T2015 is prevented from being disengaged during shipment and use after production of the ink tank T2000. Between the supporting holes T2036 and the supporting shafts T2037, minute gaps are provided in the radial direction of the supporting shafts T2037. In this way, the supporting holes T2036 do not interfere with the pivoting of the stirrer T2015 around the supporting shafts T2037.

According to this embodiment, the channel T2035 extends above the supporting holes T2036 in the direction of gravitational force inside the depression T2033. The channel T2035 according to this embodiment has a quadrangular cross-section and is formed so that the deepest area has the same depth as the depression T2033. However, the shape of the channel T2035 is not limited so long as it extends from the depression T2033 to the upper portion of the ink storage chamber T2001.

(Operation of Stirring Mechanism)

FIGS. 11A, 11B, and 11C are cross-sectional views illustrating the operation of the stirrer T2015.

FIG. 11A illustrates a first state of the stirrer T2015. When the ink tank T2000 is moved in the direction indicated by the arrow C1 as a carriage M4001 of a main body M1000 moves in one direction, the stirrer T2015 is pressed against part of the depression T2033 and the protrusions T2034 inside the depression T2033 by inertial force. The protrusions T2034 form a gap between the stirrer T2015 and the container body T2017.

FIG. 11B illustrates a second state of the stirrer T2015. Since the carriage M4001 is reciprocated, the carriage M4001 starts moving in a second direction when it reaches a predetermined point. When the carriage M4001 starts moving in the second direction, the ink tank T2000 starts moving in the direction indicated by the arrow C2. At this time, inertial force causes the free end of the stirrer T2015 to start pivoting around the supporting shafts T2037 in the direction indicated by the arrow D1. The pivoting is tolerated by the gap between the supporting shafts T2037 of the stirrer T2015 and the supporting holes T2036. As the stirrer T2015 pivots, the gap between the stirrer T2015 and the container body T2017 widens. The ink i5000 flows into this widened gap in the direction indicated by the arrow F1, as shown in FIG. 11B.

FIG. 11C illustrates a third state of the stirrer T2015. When the carriage M4001 starts moving in the opposite direction, the ink tank T2000 starts moving in the direction indicated by the arrow C1 again. At this time, inertial force causes the free end of the stirrer T2015 to start pivoting around the supporting shafts T2037 in the direction indicated by the arrow D2. As the stirrer T2015 moves closer to the inner wall of the container body T2017, the ink i5000 interposed between the stirrer T2015 and the inner wall of the container body T2017 moves in the directions indicated by the arrows F2 and F3.

The pivoting of the stirrer T2015 causes the stirrer T2015 to return from the third state to the first state. The stirrer T2015 stirs the ink i5000 by repeating the first to third states as the carriage M4001 is reciprocated.

Since the channel T2035 extends above the supporting holes T2036 in the direction of gravitational force, an ink flow is generated in the direction of the arrow F3 illustrated in FIG. 11C. Such an ink flow allows a large amount of ink i5000 to be guided to the upper area of the ink storage chamber T2001. As a result, the ink i5000 is efficiently stirred. The stirring mechanism according to this embodiment has a pivot fulcrum of the stirrer T2015 fixed at a predetermined position. However, the pivot fulcrum of the stirrer T2015 may be moveable, as in the first embodiment. In case the pivot fulcrum is moveable, the same advantages of the first embodiment can be achieved.

FIG. 12 illustrates a variation of the channel T2035.

The upper width W2 of the channel T2035 according to this embodiment is smaller than the lower width W1. The width of the channel T2035 decreases toward the upper area of the ink storage chamber T2001. In this way, the relationship of the cross-sectional area S1 of the ink entering area and the cross-sectional area S2 of the ink discharge area can be represented as S1>S2. The cross-sectional area S1 is the cross-sectional area of the lower portion of the channel T2035 when ink enters in the direction indicated by the arrow F1 in FIG. 11B. The cross-sectional area S2 is the cross-sectional area of the upper portion of the channel T2035 when ink is discharged in the direction indicated by the arrow F3 in FIG. 11C. The channel T2035 having such a dimension is capable of increasing the flow speed of the ink i5000 and improve the stirring efficiency when the ink i5000 passes through the channel T2035 in the direction indicated by the arrow F3 in FIG. 11C.

As described above, the ink tank T2000 according to this embodiment includes the stirrer T2015 of the stirring mechanism having a fixed pivot fulcrum. The ink tank T2000 according to this embodiment, similar to the above-described ink tank according to the first embodiment, has a simple structure for efficiently stirring pigment ink inside the ink storage chamber T2001 to uniformize the concentration of the pigment component in the ink. In this way, the amount of unused ink is reduced. As a result, an eco-friendly and inexpensive ink tank and an inkjet recording apparatus capable of high quality recording of an image without wasting ink are provided.

Other Embodiments

In the above-described embodiments, a depression is formed in the inner wall of the ink tank to maintain a predetermined gap between the stirrer and the inner wall of the ink tank. However, the structure for maintaining a gap is not limited and may be any type of structure that forms a predetermined gap between the stirrer and the inner wall of the ink tank when they move closest to each other. For example, a protrusion or a step-like depression may be provided on at least one of the stirrer and the inner wall of the ink tank.

The center of the movement (i.e., pivot fulcrum) of the stirrer is not limited and may be substantially horizontal or substantially vertical with respect to the orientation of the ink tank during use.

The embodiments of the present invention may be applied to various ink tanks and recording apparatuses employing various recording methods, such as an inkjet recording method.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-255427 filed Sep. 2, 2005, which is hereby incorporated by reference herein in its entirety.

What is claimed is:

1. An ink tank comprising:

an ink storage chamber;

a stirrer configured to stir ink;

a supporting unit supporting the stirrer in a freely moveable manner in directions toward and away from a first inner wall of the ink storage chamber;

a limiting portion forming a predetermined gap between opposing surfaces of the stirrer and the first inner wall when the stirrer moves closest to the first inner wall of the ink storage chamber; and a depression defined in the first inner wall, at the position where the stirrer and the first inner wall are opposing, the depression being configured to store at least a part of the stirrer.

2. The ink tank according to claim 1, wherein the limiting portion is a protrusion provided on at least one of the opposing surfaces of the stirrer and the first inner wall.

3. The ink tank according to claim 1, wherein a groove is defined in the depression.

4. The ink tank according to claim 3, wherein the groove guides the ink toward the supporting unit.

5. The ink tank according to claim 3, wherein the cross-sectional area of the groove decreases in direction of the supporting unit.

6. The ink tank according to claim 1, wherein the ink storage chamber stores pigment ink including a pigment component.

7. A recording apparatus configured to record an image on a recording medium, the image being recorded using ink supplied from the ink supply port of the ink tank according to claim 1 mounted on the mounting unit, the apparatus comprising:

a mounting unit holding the ink tank; and a moving unit configured to reciprocate the ink tank mounted on the mounting unit so as to move the stirrer by inertial force.

8. The recording apparatus according to claim 7, wherein the moving unit includes a carriage moveable in a reciprocating manner, and wherein the carriage includes the mounting unit and supports a recording head configured to discharge the ink supplied from the ink tank to the recording medium.

9. The ink tank according to claim 1, wherein the supporting unit is supported in the freely-movable manner, with a supported unit provided on an end side of the stirrer as a supporting point, and wherein the supported unit of the stirrer is enabled to move along the supporting unit.

10. The ink tank according to claim 1, wherein a tilted surface is formed in a part of the depression so as to increase the thickness of the first inner wall of the ink storage chamber.

11. An ink tank comprising, an ink storage chamber;

a stirrer configured to stir ink;

a supporting unit configured to support the stirrer in a freely movable manner in directions toward and away from a first inner wall of the ink storage chamber; and an ink supply port facilitating supplying ink inside the ink storage chamber to outside;

a limiting portion configured to form a gap between opposing surfaces of the stirrer and the first inner wall, when the stirrer moves closest to the first inner wall of the ink storage chamber; and wherein a second inner wall of the ink storage chamber opposing the first inner wall moves closer to the first inner wall as the amount of ink stored in the ink storage chamber decreases.

12. The ink tank according to claim 11, wherein the ink storage chamber includes a flexible member configured to store ink, and an urging unit configured to urge the flexible member away from the first inner wall, and wherein the stirrer is positioned between the first inner wall and the flexible member, and is supported by the supporting unit.

13. An ink tank comprising:

an ink storage chamber;

a stirrer configured to stir ink;

a supporting unit configured to support the stirrer in the freely movable manner in directions toward and away a first inner wall of the ink storage chamber;

an ink supply port facilitating supplying ink inside the ink storage chamber to outside;

a limiting portion configured to form a gap between opposing surfaces the stirrer and the first inner wall, when the stirrer moves closest to the first inner wall of the ink storage chamber; and a groove defined at the position where the stirrer and the first inner wall are opposing, wherein the cross-sectional area of the groove decreases in direction of the supporting unit.

* * * * *